United States Patent [19]

Mochida

[11] 4,424,694

[45] Jan. 10, 1984

[54] CONSTRUCTION OF CYLINDER LOCK

[75] Inventor: Haruo Mochida, Yokohama City, Japan

[73] Assignee: Nissan Motor Co., Ltd., Yokohama City, Japan

[21] Appl. No.: 305,781

[22] Filed: Sep. 25, 1981

[30] Foreign Application Priority Data

Sep. 26, 1980 [JP] Japan ..... 55-134807

[51] Int. Cl.[3] ..... E05B 63/00

[52] U.S. Cl. ..... 70/422; 70/417

[58] Field of Search ..... 70/422, 417, 416, 418

[56] References Cited

U.S. PATENT DOCUMENTS 4,056,955 11/1977 Glass ..... 70/422

FOREIGN PATENT DOCUMENTS 49050 4/1982 European Pat. Off. ..... 70/422

*Primary Examiner*—Robert L. Wolfe

*Attorney, Agent, or Firm*—Lowe, King, Price & Becker

[57] ABSTRACT

A cylinder lock is provided with means for preventing a cylinder from being extracted to improve safety against breakage of lock. The preventing means comprises a mouth member which is fixed to the cylinder at an entrance of a keyhole but capable of being broken off from the cylinder and becoming rotatable with respect to the cylinder while being undetachable. Preferably the mouth member has a hardness greater than that of the cylinder.

6 Claims, 5 Drawing Figures

CONSTRUCTION OF CYLINDER LOCK

BACKGROUND OF THE INVENTION

The present invention relates to a cylinder lock arranged to improve security against theft.

It is easy to manufacture cylinder locks of different kinds by changing the lengths of tumbler pins and their combination, making it difficult difficult to prepare a duplicate key to gain illegal access into a locked area. Due to their reliability and elaborate construction, cylinder locks are widely used. However, the aforesaid locks tend to be weak in mechanical property and therefore easily tampered with and broken without a duplicate key.

SUMMARY OF THE INVENTION

It is object of the present invention to provide a cylinder lock having an improved antitheft effectiveness.

A cylinder of a cylinder lock has a keyhole and is rotatably received in a bore formed in a casing. The cylinder is connected to the casing by a tumbler mechanism allowing the cylinder to rotate only when a correct key is inserted into the keyhole. Rotational movement of the cylinder actuates means for causing locking action to occur. According to the present invention, the cylinder has, at an entrance of the keyhole, a mouth member housing an insertion hole through which a key is inserted into the keyhole. The mouth member is fixed to but capable of being broken off from the cylinder. When broken off, the member becomes rotatable with respect to the cylinder while being undetachable therefrom. Preferably, the mouth member has a hardness value greater than that of the cylinder, and the Rockwell hardness of the inner side of the mouth member is above 60. Preferably the mouth member is embedded in the cylinder and has a collar section arranged to prevent the mouth member from being extracted.

DETAILED DESCRIPTION OF THE INVENTION

Figure 1:
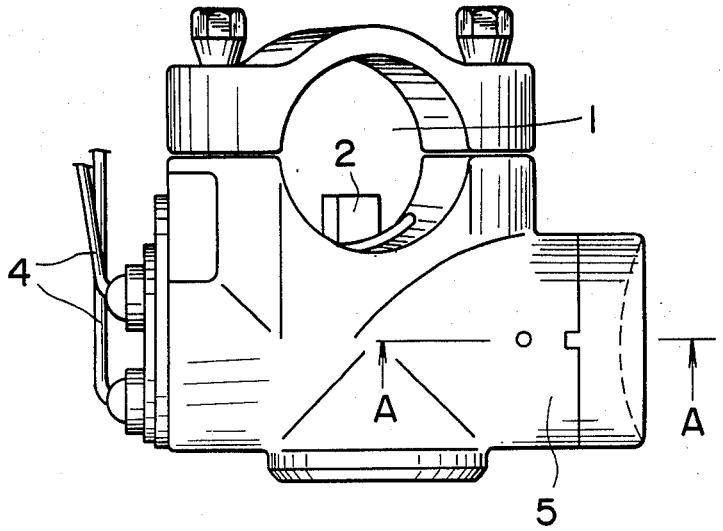
FIG. 1 PRIOR ART
FIG. 1 is a front view showing an automobile steering lock combined with an ignition switch to which the present invention is applied.
Figure 2:
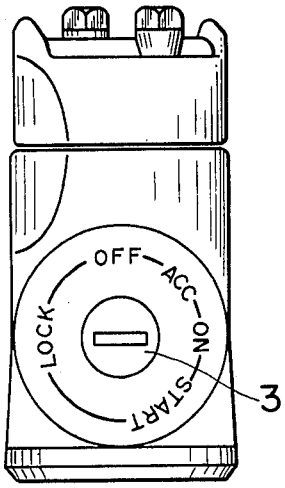
FIG. 2 PRIOR ART
FIG. 2 is a right side view of the steering lock of FIG. 1.
Figure 3:
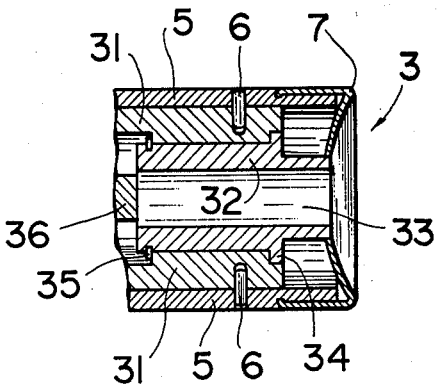
FIG. 3 PRIOR ART
FIG. 3 is a sectional view taken along the line A—A of FIG. 1 showing a conventional cylinder lock.

Referring to FIGS. 1 to 3, brief reference will first be made to a conventional cylinder lock that can be used for example, in an automobile steering lock combined with an ignition switch. Steering locks are widely used for automobiles since protection provided only by an ignition switch is insufficient. The steering lock assembly shown in FIGS. 1 to 3 has only one cylinder which serves to fasten both the ignition switch and the steering lock. A hole 1 receives a steering shaft. A bolt 2 actuated by cylinder lock 3 is insertable into a hole formed in the steering shaft to prevent rotation of the shaft. Simultaneously operation of the cylinder lock actuates the ignition switch to shut off an electric power supply through wires 4.

Cylinder lock 3 includes a casing 5 surrounding an outer cylinder 31 fastened to the casing by fast pins 6. An inner cylinder 32 having a keyhole 33 is connected to outer cylinder 31 through tumbler pins so that the inner cylinder rotates with respect to the outer cylinder when a correct key is inserted into the keyhole. Inner cylinder 32 further includes a flange 34 for preventing inward axial movement of the inner cylinder. A retaining ring 35 prevents extraction of inner cylinder 32 At the inner most portion of inner cylinder 32, there is provided an actuating member 36 which is moved by rotational movement of the inner cylinder to actuate the steering lock and ignition switch. The outer end of casing 5 is covered by a cap 7.

In the aforesaid construction, only ring 35 and cap 7 serve to prevent extraction of inner cylinder 32.

In addition, inner cylinder 32 is made of relatively soft material such as zinc die-casting alloys. Accordingly, if someone forcibly inserts a screw tap into keyhole 33, interlocks it with inner cylinder 32, and applies an impact pulling force, the retaining ring 35 easily breaks, permitting extraction of the inner cylinder so that the cylinder lock can be opened without a duplicate key. It is unfeasible to increase the strength of the retaining ring in view of its location in a restricted narrow space. This is also the case with other retaining means (not shown), such as a retaining pin.

Figure 4:
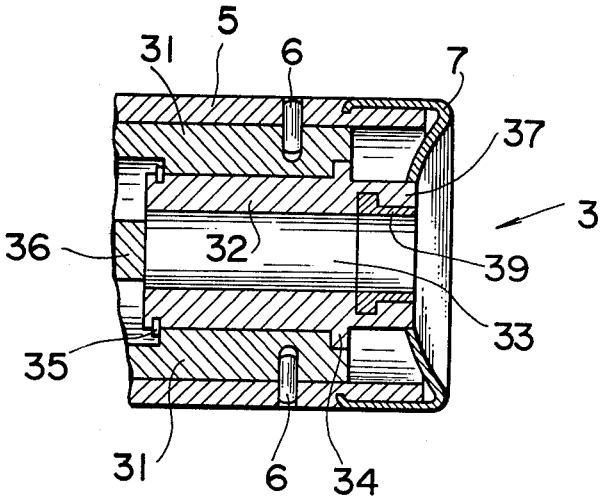
FIG. 4 is a sectional view similar to FIG. 3 showing an embodiment of the present invention.
Figure 5:
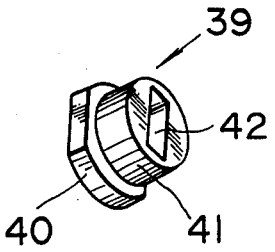
FIG. 5 is an enlarged perspective view showing a portion of the invention illustrated in FIG. 4.

In view of the foregoing description, reference is now made to FIGS. 4 and 5, wherein a preferred embodiment of the present invention is shown.

As shown in FIG. 4, inner cylinder 32 is provided with, at entrance 37 of keyhole 33, a mouth member 39. The member 39, as described hereinafter, is affixed to inner cylinder 32 but can be disconnected therefrom to become rotatable with respect to the inner cylinder when forcibly twisted with a tool, without detaching from the inner cylinder.

In this embodiment, mouth member 39 has an insertion hole 42 corresponding to keyhole 33 of inner cylinder 32, and is a single piece of metal consisting of a collar section 40 and a cylinder section 41, as shown in FIG. 5. The shape of collar section 40 is not completely circular, but includes circular peripheral portions which are cut off, forming a polygonal shape. Mouth member 39 is embedded within inner cylinder 32. Since screw taps and files found in the market are generally made from high speed steel having a Rockwell hardness of about 50 to 56, it is preferable that the inner surface of mouth member 39 has a Rockwell hardness greater than 60, thus preventing or weakening interlocking engagement between the mouth member and such tools. The construction of mouth member 39 is not limited to the foregoing description, so long as it is weakly affixed within inner cylinder 32 and provided with means for preventing it from being axially pulled and extracted.

If a screw tap or other tool is forcibly screwed into insertion hole 42, the tap can not be interlocked with the mouth member 39 because of its greater hardness than the tap. Even if the tap is interlocked with mouth member 39, engagement therebetween is weak and insufficient. Besides, if a twisting force applied to the mouth member 39 with the screw tap is unnaturally strong, the joint of the mouth member with the inner cylinder is broken Mouth member 39 begins to rotate without effect, while being undetachable from the inner cylinder. The joint between inner cylinder 32 and mouth member 39 can be easily deformed because the mouth member is made of hard material while the inner cylinder 32 is made of a relatively soft material such as zinc die-casting alloys. Thus, the mouth member diverts the twisting force exerted with the tool, and makes it much more time-consuming to break open the cylinder lock. The cylinder lock of the present invention provides an improved safety against breakage of lock while having a simple construction.

What is claimed is:

1. A cylinder lock comprising a casing having a bore;

a cylinder rotatably received in said bore of said casing and having a keyhole;

a tumbler mechanism connected with both said casing and said cylinder, allowing said cylinder to rotate only when a correct key is inserted into said keyhole;

means actuated by rotational movement of said cylinder to cause locking action of the cylinder lock; and a mouth member located within said cylinder at an entrance of said keyhole, said mouth member having an insertion hole enabling a key to be inserted therethrough into said keyhole, said mouth member including a collar section having a non-circular peripheral shape, being embedded to extend radially within the cylinder material to prevent said mouth member from being extracted or axially pulled from said cylinder when the mouth member is engaged by a tampering device, said mouth member having a hardness value greater than that of said cylinder, enabling the collar section to deform a surrounding portion of said cylinder in contact with the periphery of the collar section when engaged and twisted by said tampering device so that said mouth member rotates relative to said cylinder while remaining axially immovable, whereby said mouth member renders the tampering device substantially incapable of engaging walls of said cylinder defining the keyhole to prevent said device from forcing rotation and axial removal of said cylinder.

2. A cylinder lock according to claim 1, wherein inner walls of said mouth member defining the insertion hole has a Rockwell hardness greater than 60.

3. A cylinder lock according to claim 1, wherein said mouth member is embedded in a forward portion of said cylinder and projects forwardly from said casing to define the entrance of said keyhole.

4. A cylinder lock according to claim 3, wherein the peripheral shape of said collar section includes both arcuate and substantially straight surfaces.

5. A cylinder lock according to claim 3, wherein the periphery of said collar section is generally polygonal shaped.

6. In a cylinder lock having a cylinder rotatably received within a casing and including a keyhole enabling rotation of said cylinder to actuate a locking mechanism when a correct key is inserted into the keyhole, the improvement comprising an anti-theft member embedded within the cylinder and having wall means defining a keyhole opening through which a correct key is inserted to actuate the cylinder locking mechanism, said member further including portions attached to the wall means to project radially from the keyhole into the cylinder body, said wall means and portions being formed from material having a hardness value greater than the hardness value of the cylinder material, said member thereby being both rotatable with respect to the cylinder when said wall means is engaged by a tampering device and axially immovable from the cylinder to prevent forced rotation of the cylinder by the device or extraction from the cylinder lock.

* * * * *